US008130215B2

(12) United States Patent
Olson

(10) Patent No.: US 8,130,215 B2
(45) Date of Patent: Mar. 6, 2012

(54) LOGARITHMIC AMPLIFIER

(75) Inventor: Scot Olson, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 1064 days.

(21) Appl. No.: 11/756,002

(22) Filed: May 31, 2007

(65) Prior Publication Data

US 2008/0297225 A1 Dec. 4, 2008

(51) Int. Cl.
*G09G 5/00* (2006.01)
*G06G 7/24* (2006.01)

(52) U.S. Cl. ..... 345/204; 345/212; 345/7; 327/346; 327/351

(58) Field of Classification Search ..... 345/7, 74.1, 345/76, 77, 82, 87, 89, 90, 100, 101, 204, 345/212, 690, 691; 348/673, 185, 570, 686, 348/707; 313/495; 315/370; 327/334, 346, 327/351

See application file for complete search history.

(56) References Cited

U.S. PATENT DOCUMENTS 3,017,628 A * 1/1962 Landee et al. ..... 342/34
3,341,658 A * 9/1967 Kaneko ..... 375/362
3,509,280 A * 4/1970 Jones ..... 704/246
4,106,346 A * 8/1978 Matzuk ..... 73/614
4,198,702 A * 4/1980 Clifford ..... 367/88
4,496,982 A * 1/1985 Levine ..... 348/243
4,598,235 A * 7/1986 Ryan ..... 315/370
4,786,970 A * 11/1988 Moore ..... 348/707
5,414,313 A * 5/1995 Crescenzi et al. ..... 327/351
5,703,661 A * 12/1997 Wu ..... 348/673
6,271,940 B1 * 8/2001 Deschuytere et al. ..... 358/504
6,744,415 B2 * 6/2004 Waterman et al. ..... 345/87
7,312,780 B2 * 12/2007 Olson et al. ..... 345/102
7,751,996 B1 * 7/2010 Ardizzone et al. ..... 702/69
2002/0113808 A1 * 8/2002 Weindorf et al. ..... 345/699
2002/0140659 A1 * 10/2002 Mikami et al. ..... 345/90
2005/0190167 A1 * 9/2005 Olson et al. ..... 345/204
2008/0042993 A1 * 2/2008 Jaeger et al. ..... 345/173

* cited by examiner

*Primary Examiner* — Prabodh M Dharia
(74) *Attorney, Agent, or Firm* — Ingrassia Fisher & Lorenz, P.C.

(57) ABSTRACT

A logarithmic amplifier produces a logarithmic output signal as a function of an input signal. The amplifier comprises a reference signal, first and second function generators, and a low-pass filter. The first function generator produces a periodic exponential waveform from the reference signal based upon a resistor-capacitor time constant, wherein the exponential waveform exponentially increases from a minimum to a maximum in each period. The second function generator produces a pulsed waveform from the exponential waveform, wherein the pulsed waveform comprises a first portion having a first amplitude for a first time period and a second portion having a different amplitude for the remainder of the signal period, and wherein the duration of the first time period is determined in response to the exponential waveform. The low pass filter produces the logarithmic output signal as a function of the pulsed waveform.

18 Claims, 3 Drawing Sheets

LOGARITHMIC AMPLIFIER

TECHNICAL FIELD

The present invention generally relates to amplifier circuits, and more particularly relates to amplifier circuits with logarithmic amplification characteristics.

BACKGROUND

An amplifier is any device or circuit capable of increasing the voltage, current and/or power of an applied input signal. Amplifiers are well-known devices that have been used in many different electrical and electronic environments for many years. Many amplifiers are described as "linear", "exponential", "logarithmic" or the like in accordance with the shape of their output vs. input characteristics. A "logarithmic" amplifier, for example, typically produces an output signal that increases logarithmically as the input signal is increased. This characteristic may be beneficial in many applications because small changes in input signal can produce relatively large effects upon the amplifier output. In a flat panel or other visual display, for example, it may be desirable for the brightness of the display to increase and/or decrease logarithmically as a control knob or other input is adjusted to reflect the sensitivity of the human eye.

Typically, logarithmic and anti-logarithmic amplifiers are designed to be based upon the electronic properties of a conventional P-N junction, which is generally implemented in doped silicon or other semi-conducting material. Semiconductors can be complicated and expensive to fabricate, however, particularly for specialized environments. As a result, it is desirable to create a logarithmic amplifier that can produce precise and accurate output over a range of environmental conditions but without the disadvantages inherent in amplifiers based upon the transfer characteristic of a P-N junction. It is also desirable to produce flat panel displays with improved logarithmic amplifier features.

SUMMARY

According to an exemplary embodiment, a logarithmic amplifier is configured to produce an output signal that is a logarithmic function of an input signal. The amplifier comprises a reference signal, first and second function generators, and a low-pass filter. The first function generator is configured to produce a periodic exponential waveform from the reference signal based upon a resistor-capacitor time constant, wherein the exponential waveform exponentially increases from a minimum value to a maximum value in each period. The second function generator is configured to produce a pulsed waveform from the exponential waveform, wherein the pulsed waveform has a signal period equal to that of the exponential waveform, and wherein the pulsed waveform comprises a first portion having a first amplitude for a first time period and a second portion having a different amplitude for the remainder of the signal period, and wherein the duration of the first time period is determined in response to the exponential waveform. The low pass filter then produces the logarithmic output signal as a function of the pulsed waveform.

BRIEF DESCRIPTION OF THE DRAWINGS

The present invention will hereinafter be described in conjunction with the following drawing figures, wherein like numerals denote like elements.

DETAILED DESCRIPTION

Before proceeding with the detailed description, it is to be appreciated that the described embodiments are applicable to a wide range of electrical and electronics application, and are not limited to use in conjunction with particular environments described herein. Although the present embodiment is depicted and described as being implemented in a the context of a visual display herein, for example, equivalent principles and concepts can be implemented in various other types of applications, and in various other systems and environments.

According to various exemplary embodiments, a new logarithmic amplifier circuit produces an output signal as a function of a conventional resistor-capacitor (RC) time constant rather than as a function of the charge transfer characteristic of a P-N junction. Unlike most conventional RC circuits, which are highly temperature dependent, the amplifier circuits described below are capable of producing an accurate response across a range of temperatures. By properly generating and recovering the RC rise time characteristic, the temperature dependence and tolerance variation effects typically observed in conventional RC circuits can be eliminated.

Figure 1:
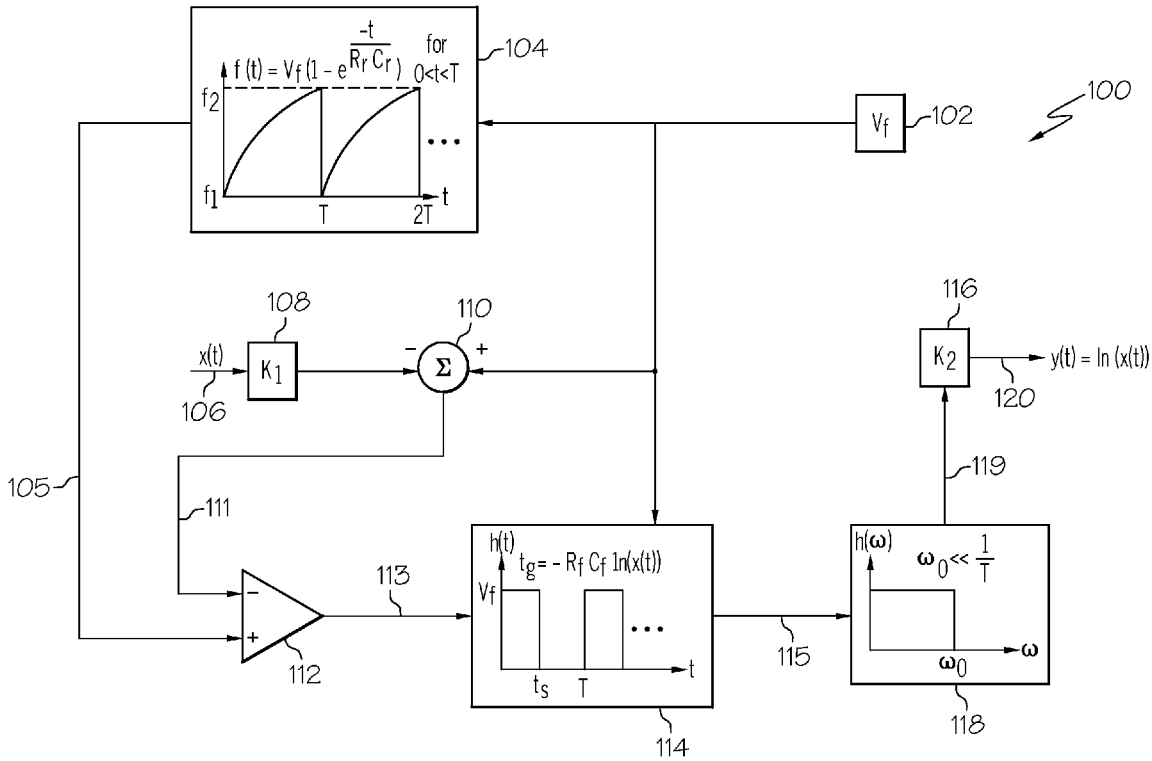
FIG. 1 is a block diagram of an exemplary logarithmic amplifier.

With initial reference to FIG. 1, an exemplary logarithmic amplifier 100 suitably includes a reference signal 102, a first function generator 104, a second function generator 114, and a low pass filter 118. Various other signal blending or modifying features may also be provided based upon the particular embodiment and implementation. For example, scaling modules 108 and/or 116 may be provided along with summing junction 110 and/or difference amplifier 112, as appropriate.

In the embodiments shown and discussed herein, an effort has been made to simplify the discussion by providing "pure" logarithmic output signals that are simply the natural logarithm of the input signals without any additional scaling or processing. This unadulterated signal is produced using various scaling and signal-combining features within the circuit that may not be included in all embodiments. Stated another way, many equivalent embodiments may incorporate different amplitude scaling, signal combinations and/or the like by including different and/or additional circuitry, by using different or additional reference signals, and/or the like. Additionally, the various components shown in the figures may be logically or physically arranged with respect to each other in any manner. Equivalent embodiments may combine the difference amplifier feature (element 112 in FIG. 1) with the second function generator (element 114 in FIG. 1), for example. Many other digital, analog, discrete and/or integrated components may therefore be arranged or otherwise interconnected in any manner across a wide array of equivalent embodiments.

The first function generator 104 is any circuitry, logic or other module capable of producing a periodic exponential waveform 105 from reference signal 102. In various embodiments, reference signal 102 is a reference voltage that may be received from an external source (e.g. a battery or rail voltage) or that may be alternately processed internal to circuit 100 as appropriate. Function generator 104 suitably produces an exponential waveform 105 as a function of a resistor-capacitor (RC) rise time. That is, as reference signal 102 is applied to a resistor-capacitor circuit or network, the RC time constant of the circuit generally produces a voltage that exponentially increases with time. Function generator 104 suitably shapes signal 105 such that it repeats periodically (having a suitable period T) and such that it exponentially rises from a minimum value ($f_1$) to a maximum value ($f_2$) during each period. One technique for generating such a signal is described below in conjunction with FIGS. 2 and 3.

In the embodiment shown in FIG. 1, the signal x(t) 106 that is provided as a control input to amplifier 100 is suitably scaled 108 and summed 110 with reference signal 102 to produce a scaled representation 111 of input signal 106. The scaled representation may be generated in any manner. For example, scaling 108 may be accomplished using any sort of amplifier (e.g. an operational amplifier) or attenuation circuit, voltage divider circuit, or any other sort of analog and/or digital circuitry as appropriate. In the embodiments described herein, the scaled representation 111 may be alternately referred to as signal g(x), although other embodiments may incorporate any sort of scaling, signal combining or other processing as appropriate, or may eliminate signal processing/scaling entirely.

The second function generator 114 suitably produces a periodic pulsed output signal 115 that includes a first amplitude for a first time period and a second amplitude different from the first for the remainder of the signal period. The period of the pulsed output signal 115 is shown to be the same as that of signal 105. In various embodiments, the pulsed output 115 is produced in response to a difference signal 113 that is representative of the difference between the scaled representation 111 of input signal 106 and exponential signal 105. As exponential signal 105 exceeds the scaled representation 111, for example, the reference signal 102 can be provided as pulsed output 115, with a different value (e.g. zero or null or some other reference value) provided during the remainder of the signal period. In various embodiments, the second function generator 114 includes or operates in conjunction with a difference amplifier or comparator 112 to produce difference signal 113.

The pulsed signal 115 thereby represents a pulse-width modulated representation of the relative time that exponential signal 105 exceeds the scaled input signal 111. As the input signal 106 is increased (e.g. in response to the user adjusting a potentiometer knob or other control), the relative portion of time in period T that the exponential signal 105 exceeds the scaled representation 111 will decrease. The time at which the two signals 105 and 111 are equal to each other is referenced herein as time $t_g$. In general, pulsed signal 115 is considered to provide the reference signal 102 prior to time $t_g$, and to otherwise provide a zero or null signal for the remainder of period T. Again, other embodiments may include radically different signaling, scaling and implementation schemes of equivalent concepts.

The pulsed output signal 115 is appropriately passed through a filter 118 to remove high frequency components, and the resulting signal 119 will provide a logarithmic representation of the input signal 106 that can be scaled 116 or otherwise processed as appropriate to provide a suitable output signal 120. Filter 118 is any low-pass filter capable of providing the direct current (DC) component of signal 115 at filtered output signal 119. Typically, a low pass filter can be designed using simple components (e.g. capacitors, resistors) to have a cutoff frequency that is below the frequency (1/T) of signal 115, thereby ensuring proper operation. In various embodiments, scaling 116 of filtered signal 119 can be accomplished with any type of amplifier, attenuator, voltage divider or other suitable circuitry. In still other embodiments, scaling 116 is removed entirely from amplifier 100.

Amplifier 100 provides numerous benefits over other amplifiers currently available. Rather than relying upon characteristics of a PN junction, for example, function generator 104 is able to generate a logarithmic function using a simple resistor-capacitor (RC) rise time that can be produced with simple and inexpensive discrete components. Similarly, the other components of amplifier 100 may be implemented with conventional discrete elements, further reducing the cost of such embodiments. Moreover, by generating and extracting the logarithmic characteristic in the manner described herein, the temperature dependence and other adverse affects typically associated with RC circuits can be avoided. The mathematical basis for an exemplary embodiment is provided below.

Figure 2:
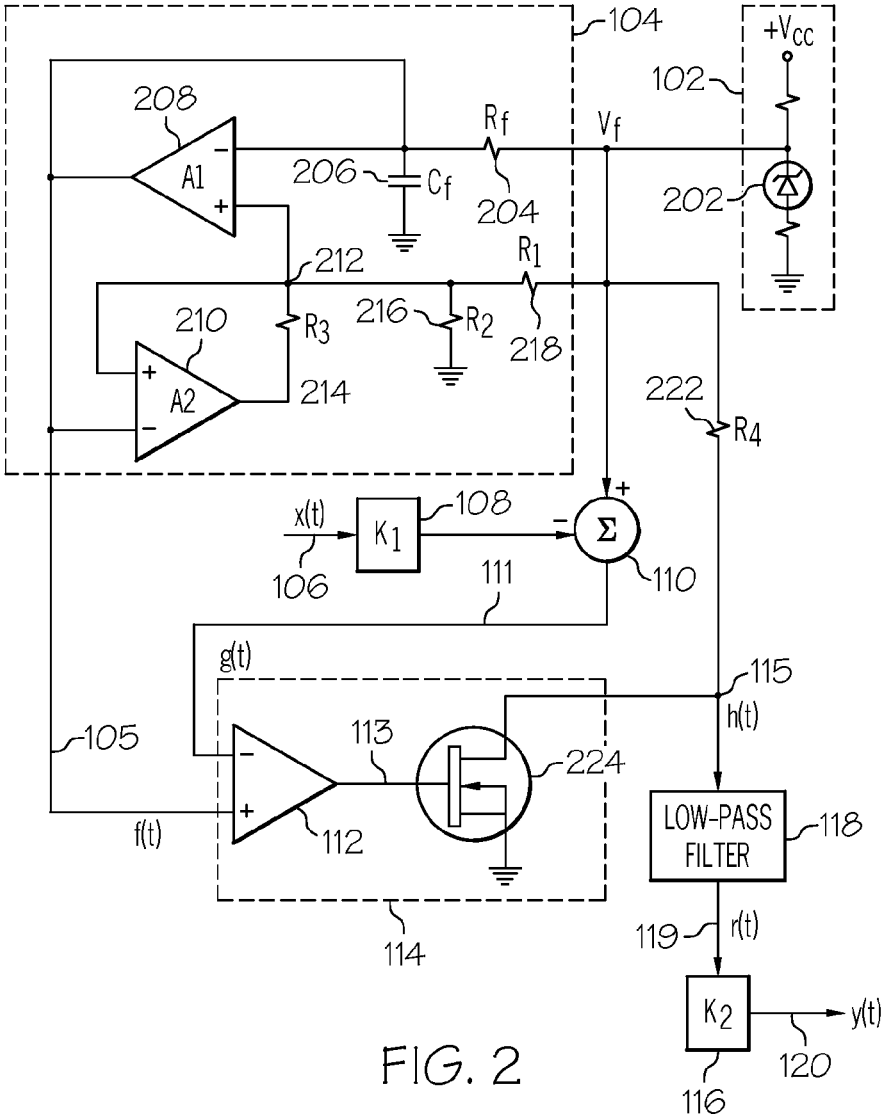
FIG. 2 is a circuit diagram showing additional detail of an exemplary logarithmic amplifier.

FIG. 2 describes an analog implementation of logarithmic amplifier circuit that generally parallels the amplifier 100 described in FIG. 1. With reference now to FIG. 2, the amplifier suitably includes a reference signal 102, a first function generator 104, a second function generator 114 and a low-pass filter 118 that produces an output signal 120 in response to an input signal 106.

Reference signal 102 (also referenced herein as $V_f$) is suitably produced by any accurate voltage or current source. In various embodiments, reference signal 102 is produced in response to a battery, rail or other reference voltage ($V_{cc}$). This reference input may be regulated by, for example, coupling a precision shunt resistance 202 in parallel to the signal load, although this feature is not included in all embodiments.

Function generator 104 produces a periodic exponential waveform 105 from the reference signal 102 in response to an RC rise time produced by resistor 204 and capacitor 206. This signal 105 (also referenced as f(t)) is generally produced by the interaction of comparators 208 and 210 with resistors $R_3$ 214, $R_2$ 216, $R_1$ 218. Assuming momentarily that the output of comparator 210 is initially zero, the voltage on signal 105 is shown through simple application of Ohm's law to be:

$$f_1 = V_f \frac{R_2 R_3}{R_1 R_2 + R_1 R_3 + R_2 R_3} \tag{1}$$

If $R_3$ is designed to be much smaller than $R_1$ and $R_2$ (which is not necessary in all embodiments, but which simplifies the mathematics for this description), Equation (1) simplifies such that $f_1$ is approximately zero. Applying similar analysis when the output of comparator 210 is open, signal 105 will be given by Equation (2):

$$f_2 = V_f \frac{R_2}{R_1 + R_2} \tag{2}$$

During the interval between Equations (1) and (2), the current in resistor 204 can be expressed as:

$$i_f = \frac{V_f - f(t)}{R_f} = C_f \frac{df(t)}{dt} \tag{3}$$

which can be readily solved at for 0<t<T to:

$$f(t) = V_f\left(1 - e^{\frac{-t}{R_f C_f}}\right) \tag{4}$$

Figure 3:
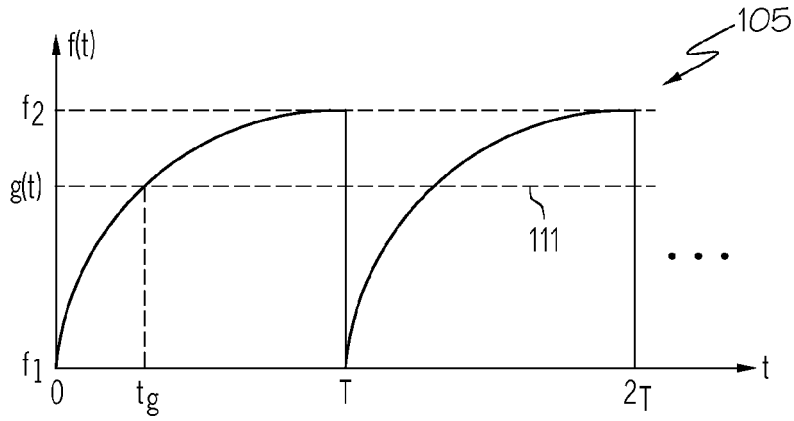
FIG. 3 is a plot of an exemplary voltage characteristic generated as part of an exemplary logarithmic amplifier.
Figure 4:
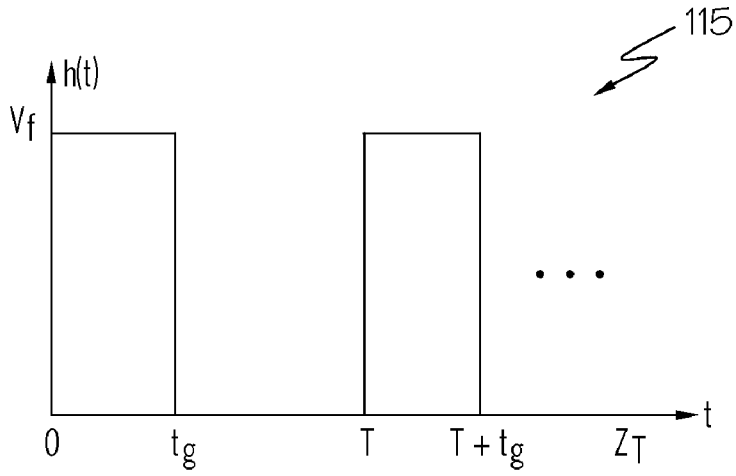
FIG. 4 is a plot of an exemplary voltage characteristic generated as part of an exemplary logarithmic amplifier.

An exemplary plot of the resulting periodic logarithmic increase from $f_1$ to $f_2$ is shown in FIG. 3. Additionally, if resistor 216 is designed to be larger than resistor 218 for simplicity, it can be readily shown from Equations (2) and (4) that the period (T) is expressed by:

$$T \approx -R_f C_f \ln\frac{R_1}{R_2} \tag{5}$$

The second function generator 114 in FIG. 2 produces a pulsed output signal 115 (also shown as h(t)) as described above. In various embodiments, function generator 114 suitably includes a comparator 112 and a switching element (e.g. a FET or other transistor) 224 configured as shown. In this embodiment, comparator 112 provides a difference output 113 that represents the difference between signals 105 and 111. Scaled representation 11 of input signal 106 in FIG. 2 can be readily shown as a function of the input x(t) (i.e. signal 106) as follows:

$$g(t)=V_f-k_1x(t) \tag{6}$$

Since signal 111 generally varies very slowing with respect to signal 105, it can be considered for present purposes to act as a constant, shown as line 105 in FIG. 3. When signals 105 and 111 are equal to each other (at a time $t_g$), Equations (4) and (6) can be set equal to each other and simplified as follows:

$$V_f e^{\frac{-t_g}{R_f C_f}} = k_1 x(t) \tag{7}$$

Solving for $t_g$ and (for purposes of simplicity) designing $k_1$ to be equal to $V_f$ provides that:

$$t_g=-R_fC_f ln(x(t)) \tag{8}$$

Assuming that the input impedance to the low pass filter 118 is designed to be greater than the resistance 222 between reference signal 102 and the filter 118, a signal such as that shown in FIG. 3 can be provided as pulsed signal 115. This signal is produced by comparator 112 and switching element 224 as described above. That is, pulsed signal 115 is simply the reference signal 112 while signal 105 exceeds signal 111 prior to time $t_g$, with switching element 224 otherwise pulling signal 115 to ground (or another reference) for the remainder of the signal period as appropriate.

As noted above, the cutoff frequency for filter 118 is designed to be lower than the frequency (1/T) of signal 115, meaning that the filter 118 removes the harmonics of the signal 115 to produce output signal 119 (also shown as signal r(t)) that is effectively the DC component of signal 115. Stated mathematically, $$r(t) = \frac{1}{T}\int_0^T dt' h(t') \tag{9}$$

Noting that r(t) is set to ground (or the low reference) between times $t_g$ and T, however, and substituting (5) for T, it can be shown that:

$$r(t) = \frac{1}{R_f C_f \ln\frac{R_1}{R_2}}\int_0^{t_g} dt' h(t') = \frac{-V_f t_g}{R_f C_f \ln\frac{R_1}{R_2}} \tag{10}$$

Substituting Equation (8) into Equation (10) and simplifying, it can be shown that:

$$r(t) = \frac{-V_f(-R_f C_f \ln(x(t)))}{R_f C_f \ln\frac{R_1}{R_2}} = \frac{V_f}{\ln\frac{R_1}{R_2}}\ln(x(t)) \tag{11}$$

From the rightmost term of Equation (11), it should be noted that $V_f$, $R_1$ and $R_2$ are constants, and that the values of $R_f$ and $C_f$ have cancelled, thereby eliminating the temperature-dependent effects of resistor 204 and capacitor 206 in FIG. 2. As a result, the logarithmic characteristic provided at the output 120 can be shown to vary solely as a logarithmic function of the input signal 106. If scaling 116 is subsequently provided such that $k_2$ is designed to negate the constants in the rightmost term of Equation (11), then it can be readily shown that the output function 120 is simply the logarithm of the input function 106, or:

$$y(t)=ln[x(t)] \tag{12}$$

Figure 5:
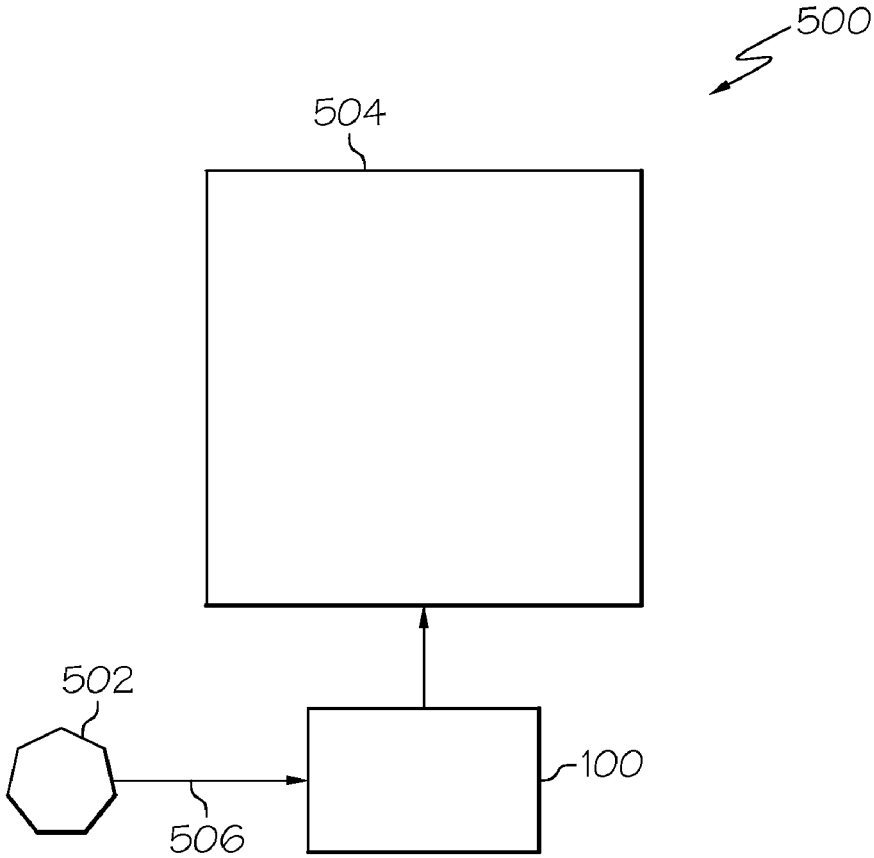
FIG. 5 is a block diagram of an exemplary display with logarithmically-increasing parameter adjustment.

With final reference now to FIG. 5, a display system 500 can be designed with a logarithmic amplifier module 100 as described above. In the exemplary embodiment of FIG. 5, for example, system 500 suitably includes a logarithmic amplifier 100 interconnecting a display 504 and a control device 502. Display 504 is any type of display device having an adjustable parameter. In various embodiments, display 504 is a flat panel display, cathode ray tube (CRT) and/or the like with an adjustable brightness, contrast and/or other parameter. Control device 502 is any type of knob, keypad, slider, button or other digital and/or analog input device capable of receiving an input from a user and providing an electrical indication thereof. In various embodiments, control device 502 includes any sort of potentiometer or other control capable of providing a voltage or other signal 506 that is indicative of the user input. In the event that the user desires to adjust the parameter of display 504, signal 506 can be amplified by amplifier 100. Numerous changes in the arrangement and operation of display system 500 could be formulated across a wide array of equivalent embodiments.

While the invention has been described with reference to an exemplary embodiment, various changes may be made and many different equivalents may be substituted for elements thereof without departing from the scope of the invention. In addition, many modifications may be made to adapt to a particular situation or material to the teachings of the invention without departing from the scope thereof. It is therefore intended that the invention not be limited to any particular embodiment disclosed herein, but rather that the invention will include all embodiments falling within the scope of the appended claims and the legal equivalents thereof.

What is claimed is:

1. A logarithmic amplifier configured to produce a logarithmic output signal that is a logarithmic function of an input signal, the amplifier comprising:

a reference signal;

a first function generator configured to produce a periodic exponential waveform from the reference signal based upon a resisitor-capacitor time constant, wherein the logarithmic waveform increases from a minimum value to a maximum value in each period;

a second function generator configured to produce a pulsed waveform from the exponential waveform, wherein the pulsed waveform has a signal period, and wherein the pulsed waveform comprises a first portion having a first amplitude for a first time period and a second portion having a different amplitude for the remainder of the signal period, and wherein the duration of the first time period is produced by comparing the exponential waveform produced by the first function generator to a scaled representation of the input signal so that changes in the input signal affect the duration of the first time period; and a low pass filter configured to produce the logarithmic output signal as a function of the pulsed waveform, wherein the low pass filter has a cutoff frequency that is less than the frequency of the pulsed waveform to provide the DC component of the pulsed waveform as the logarithmic output signal, wherein the logarithmic output signal is independent of variation in the resistor-capacitor time constant due to changes in temperature.

2. The logarithmic amplifier of claim 1 wherein the first amplitude of the pulsed waveform is substantially equal to the reference signal.

3. The logarithmic amplifier of claim 1 wherein the second function generator comprises a difference amplifier configured to produce a difference signal representing the difference between the exponential waveform and the scaled representation of the input signal.

4. The logarithmic amplifier of claim 3 wherein the second function generator further comprises a switching element configured to apply the reference signal as the pulsed waveform when the exponential waveform exceeds the scaled representation of the input signal, and to otherwise not apply the reference signal as the pulsed waveform.

5. The logarithmic amplifier of claim 4 wherein the switching element comprises a transistor.

6. The logarithmic amplifier of claim 1 wherein the first function generator comprises a first comparator coupled to the reference signal via a resistor and a capacitor to thereby produce the resistor-capacitor time constant.

7. The logarithmic amplifier of claim 6 wherein the first function generator further comprises a second comparator.

8. A display system responsive to a user input, the system comprising:

a user control configured to provide a control signal in response to the user input;

an logarithmic amplifier configured to receive the control signal, wherein the logarithmic amplifier comprises:

a reference signal;

a first function generator configured to produce a periodic exponential waveform from the reference signal based upon a resisitor-capacitor time constant, wherein the exponential waveform exponentially increases from a minimum value to a maximum value in each period;

a second function generator configured to produce a pulsed waveform from the exponential waveform and the control signal, wherein the pulsed waveform has a signal period, and wherein the pulsed waveform comprises a first portion having a first amplitude for a first time period and a second portion having a different amplitude for the remainder of the signal period, and wherein the duration of the first time period is produced by comparing the exponential waveform produced by the first function generator to a scaled representation of the control signal so that changes in the control signal affect the duration of the first time period; and a low pass filter configured to produce a logarithmic adjustment signal as a logarithmic function of the pulsed waveform, wherein the low pass filter has a cutoff frequency that is less than the frequency of the pulsed waveform to the DC component of the pulsed waveform as the logarithmic adjustment signal, wherein the logarithmic adjustment signal is independent of variation in the resistor-capacitor time constant due to changes in temperature; and a display having a variable parameter, wherein the display is configured to receive the logarithmic adjustment signal and to adjust the parameter in response to the logarithmic adjustment signal.

9. The display of claim 8 wherein the parameter is a brightness of the display.

10. The display of claim 8 wherein the user control comprises a potentiometer.

11. The display of claim 8 wherein the first function generator comprises a first comparator coupled to the reference signal via a resistor and a capacitor to thereby produce the resistor-capacitor time constant.

12. A method of producing an output voltage that is a logarithmic function of an input voltage, the method comprising the steps of:

generating a periodic exponential waveform with a resistor-capacitor time constant;

producing a pulsed waveform having a signal period substantially equal to the period of the exponential waveform, wherein the pulsed waveform comprises a first portion having a first amplitude and a first duration, and a second portion having a second amplitude different from the first amplitude, and wherein the second portion extends for the remainder of the signal period following the first duration; and wherein the pulsed waveform is produced by comparing the exponential waveform produced by the first function generator to a scaled representation of the control signal so that changes in the control signal affect the duration of the first time period filtering the pulsed waveform using a low pass filter that has a cutoff frequency that is less than the frequency of the pulsed waveform to thereby extract the output voltage as the logarithmic function of the input voltage, wherein the output voltage is the DC component of the pulsed waveform and is independent of variation in the resistor-capacitor time constant due to changes in temperature.

13. The method of claim 12 wherein the filtering step comprises low-pass filtering the pulsed waveform to remove harmonic components of the pulsed waveform.

14. The method of claim 12 further comprising the step of comparing a scaled representation of the input signal to the exponential waveform.

15. The method of claim 14 wherein the first duration extends from the beginning of the signal period until the scaled representation of the input signal substantially equals the exponential waveform.

16. The method of claim 14 further comprising the step of amplifying the input signal to produce the scaled representation.

17. The method of claim 12 wherein the exponential waveform periodically varies from an initial voltage to a reference voltage.

18. The method of claim 17 wherein the first amplitude of the pulsed signal is substantially equal to the reference voltage.

* * * * *